United States Patent [19]

Arnott

[11] Patent Number: 4,680,034

[45] Date of Patent: Jul. 14, 1987

[54] HIGH CONTRAST PATTERNING PROCESS AND PRODUCT FOR DISPERSE DYED POLYESTER

[75] Inventor: Robert C. Arnott, Spartanburg, S.C.

[73] Assignee: Milliken Research Corporation, Spartanburg, S.C.

[21] Appl. No.: 721,502

[22] Filed: Apr. 10, 1985

Related U.S. Application Data

[63] Continuation of Ser. No. 479,410, Mar. 28, 1983, abandoned.

[51] Int. Cl.[4] ..... D06P 5/00

[52] U.S. Cl. ..... 8/481; 8/478; 8/486; 8/607; 8/611; 8/614; 8/922

[58] Field of Search ..... 8/481, 486, 478

[56] References Cited

U.S. PATENT DOCUMENTS

| | | | |
|---|---|---|---|
| 1,534,304 | 4/1925 | Creasey | 8/478 |
| 2,113,935 | 4/1938 | Dreyfus | 8/114 |
| 3,153,106 | 10/1964 | Schlick | 264/78 |
| 3,177,644 | 4/1965 | Aspy et al. | 57/245 |
| 3,669,611 | 6/1972 | Shimauchi et al. | 8/481 |
| 3,989,448 | 11/1976 | Bohrn | 8/497 |
| 4,121,899 | 10/1978 | Chambers et al. | 8/473 |
| 4,155,856 | 5/1979 | Reinert et al. | 252/8.9 |
| 4,238,190 | 12/1980 | Rejto | 8/471 |
| 4,255,150 | 3/1981 | Fennekels et al. | 8/471 |
| 4,260,390 | 4/1981 | Lewis | 8/481 |
| 4,286,955 | 9/1981 | Lewis | 8/115.6 |
| 4,364,156 | 12/1982 | Greenway et al. | 26/2 R |
| 4,417,897 | 11/1983 | Stahl et al. | 8/464 |

OTHER PUBLICATIONS

H. Weigmann et al., *Textile Research Journal,* Jan. 1978, pp. 4–13.

M. Joseph, *Introductory Textile Science,* Fourth Edition, Holt, Rinehart and Winston, New York, pp. 15–17.

H. Weigmann et al., *Textile Research Journal,* Aug. 1976, pp. 574–587.

H. Weigmann et al., *Textile Research Journal,* Nov. 1977, pp. 745–754.

H. Weigmann et al., *Textile Research Journal,* Dec. 1977, pp. 761–771.

A. Ribnick et al., *Textile Research Journal,* Mar. 1973, pp. 176–183.

B. Knox et al., *Textile Research Journal,* Mar. 1975, pp. 203–217.

H. Weigmann et al., *Textile Research Journal, Jul. 1975, pp. 554–567.*

*Primary Examiner*—A. Lionel Clingman

*Attorney, Agent, or Firm*—George M. Fisher; H. William Petry

[57] ABSTRACT

A method is disclosed for patterning a textile substrate by treating the substrate surface in a pattern configuration, for example, using heated air streams, to allow a later-applied solvent to extract dye from the treated areas at a faster rate than from untreated areas. A patterned product is also disclosed.

14 Claims, 4 Drawing Figures

HIGH CONTRAST PATTERNING PROCESS AND PRODUCT FOR DISPERSE DYED POLYESTER

This is a continuation of Ser. No. 479,410 filed Mar. 28, 1983 and abandoned.

This invention relates to a process for generating patterns exhibiting high visual contrast on textile substrates, and novel products which may be produced thereby. More specifically, one embodiment of this invention relates to a process wherein individual constituent fibers in an area on the surface of a textile substrate defining a pattern are thermally conditioned or treated to permit relatively rapid extraction of dye from those fibers by a solvent, while adjacent fibers which have not been so thermally conditioned or treated resist such rapid dye extraction, thereby resulting in fabrics wherein, following the controlled exposure to a suitable solvent, the heat-treated pattern areas contain visually less dye than adjacent, solvent exposed pattern-complementary areas.

Processes for generating patterns on the surface of textile substrates are well known in the art. Such processes may or may not require the pattern-wise application of dye to achieve a pattern, or even a dye-defined pattern, on the substrate surface. Among those processes which do not require the pattern-wise application of dye are included processes wherein heat, for example, from a heated embossing roll or in the form of impinging heated fluid streams, is directed onto the substrate surface in a pattern configuration prior to a dyeing step. The thermally treated portions of the surface accept dye to a different (generally greater) degree than do the untreated portions, thereby usually resulting in pattern areas having higher, visually contrasting dye concentrations. Other processes rely on a variety of physical effects to define or establish patterned areas on the substrate surface. For example, some processes rely on physical compression and perhaps heat setting of individual fibers to imprint the surface and thereby define a pattern. Other systems may rely on fiber entanglement to yield visually distinct areas on the substrate surface.

A process disclosed in commonly assigned U.S. patent application Ser. No. 253,135, filed Apr. 13, 1981, now abandoned, the disclosure of which is hereby incorporated by reference, relies upon streams of heated fluid, which are made to impinge upon the substrate surface in a pattern configuration, to selectively shrink, melt, or otherwise thermally deform or distort individual yarns or portions of individual yarns comprising the substrate surface, thereby producing visually distinct areas on the substrate surface in those areas containing yarns exposed to the heated fluid streams.

This technique can produce patterns which are quite detailed and which, under some circumstances, can achieve rather high levels of visual contrast between pattern and pattern-complementary (i.e., background) areas, even though not requiring the pattern-wise application of dye. This is particularly true if the substrate is, for example, a pile fabric and the pile yarns have been heated sufficiently to induce substantial thermally-induced longitudinal shrinkage among the individual pile yarns. The resulting sculptured or surface contoured effect can result in dramatic contrast levels between pattern and pattern-complementary areas, provided the surface is appropriately illuminated. However, the degree of contrast is often heavily dependent upon the type and direction of the incident illumination. When non-pile textile substrates are patterned using this technique, the individual fibers are softened and may undergo some shrinking or melting; contrast, however, is frequently limited even under optimum illumination with such fabrics. Using a dye which is selectively applied in pattern areas only can impose formidable constraints if fine detail, or strict reproduceability, as well as production speed and inventory flexability, is desired. Colors must be carefully matched, dye runs coordinated and scheduled, and, of course, the dye must be applied with great precision and accuracy. These constraints have been formidable.

It is therefore desired to have available an economical, commercially practical process wherein patterning may be achieved using the pattern-wise application of heat or other conditioning agent, rather than the pattern-wise application of dye, to individual yarns on the substrate surface, and wherein the degree of visual contrast between pattern and pattern-complementary areas on the substrate surface may be controllably varied from relatively low to relatively high values, and wherein the perceived contrast is not significantly dependent upon the nature of the illumination. The process of this invention involves the treating or conditioning, by physical or other means, of individual yarns in the pattern areas of the substrate to permit the subsequent selective extraction of dye in treated yarns processed in a controlled solvent-based extraction step, which extraction step has substantially no visible effect on adjacent, untreated yarns forming the pattern-complementary areas of the substrate. The dye may be applied to the yarns either prior to or following the treating or conditioning step. The role played by the treating or conditioning agent in this invention may be thought of as being somewhat similar to that of a catalyst, in the sense that the chosen solvent extracts dye with much greater speed from the treated yarns than from the untreated yarns. Generally speaking, the chosen solvents useful in the practice of this invention will, given sufficient exposure, extract dye from untreated areas as well as treated areas, and perhaps to the same extent, but will not do so at the same rate.

In one preferred embodiment of the invention, a textile fabric comprised of polyester (e.g., polyethylene teraphthalate) yarns which have been conventionally dyed with a disperse dye is impinged with heated streams of fluid, for example, air, in a pattern-wise configuration by an apparatus similar to that disclosed in commonly assigned U.S. patent application Ser. No. 253,135, referenced above. This apparatus is discussed herein as merely one example of an apparatus which may be used to practice this invention; commonly assigned U.S. Pat. No. 4,364,156, also incorporated by reference herein, further defines a manifold which may prove advantageous when used in conjunction with the apparatus of U.S. patent application Ser. No. 253,135. It is believed any means by which appropriate amounts of heat may be suitably applied in a pattern-wise configuration to the yarns comprising the surface of the textile substrate to be patterned may be employed. For example, a laser beam of suitable power and intensity, directed onto or over the substrate surface in a pattern configuration, may be used instead of heated air streams.

Figure 1:
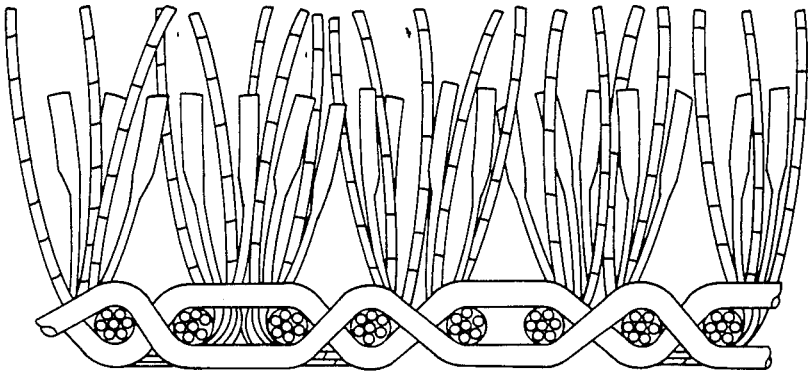
FIG. 1 depicts a pile fabric, comprised of thermoplastic and non-thermoplastic yarns, in which heat conditioning has caused thermal deformation, in the form of longitudinal shrinkage, to individual thermoplastic pile yarns; dye has then been selectively extracted from those thermally deformed fibers.
Figure 2:
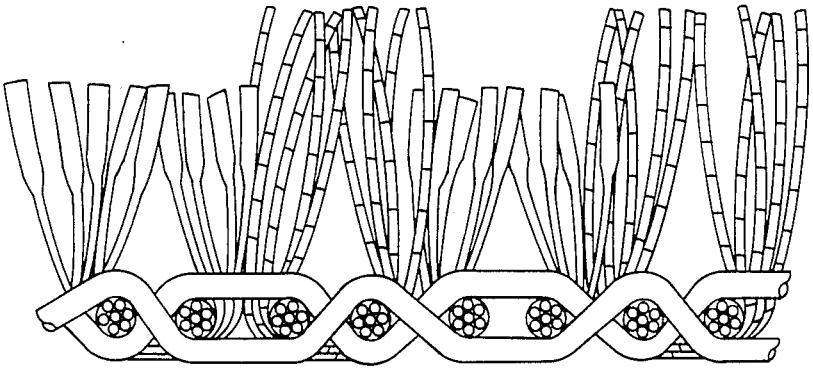
FIG. 2 depicts a pile fabric in which heat conditioning has caused thermal deformation, in the form of longitudinal shrinkage, to tufts or groups of thermoplastic pile yarns; dye has then been selectively extracted from those thermally deformed yarn groups.
Figure 3:
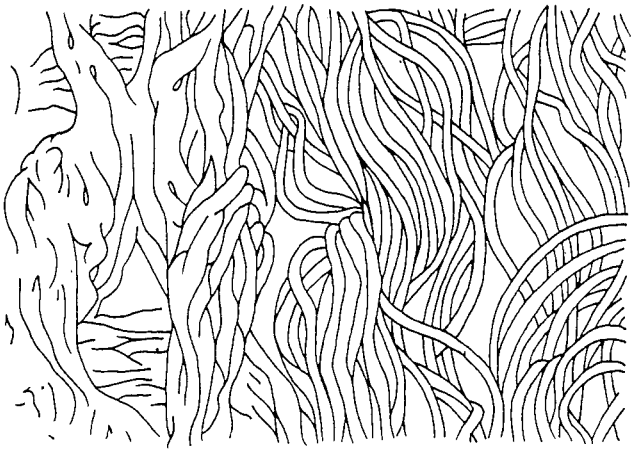
FIG. 3 depicts a flat knitted fabric comprised of thermoplastic yarns wherein heat conditioning has caused thermal deformation, in the form of melting and/or fusing of individual yarns; dye is selectively extracted from the deformed region of the fabric.
Figure 4:
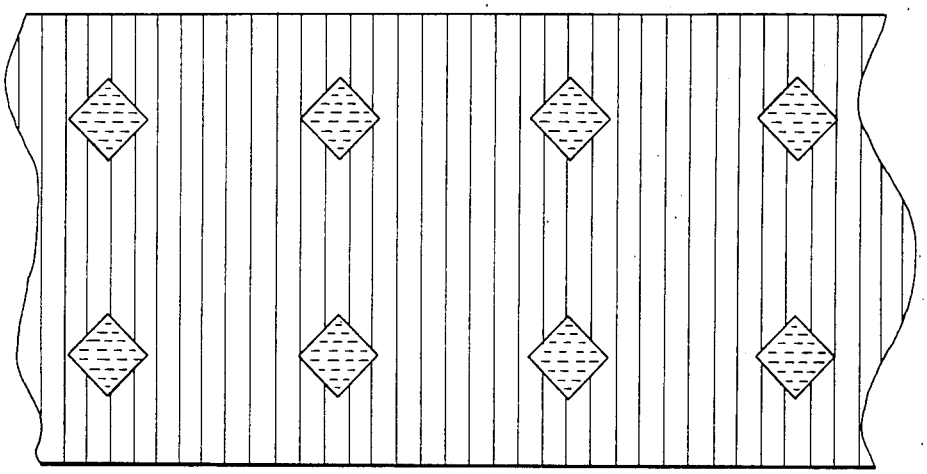
FIG. 4 depicts a textile substrate in which dye has been selectively extracted from the heat-treated diamond-shaped areas, in accordance with the teachings of this invention.

It is theorized that, where thermal energy is used to condition the yarns, the heat tends to induce a decrease in the internal orientation of at least portions of individual, untensioned yarns in those pattern areas where the maximum rate of solvent extraction of dye is desired. The decrease in orientation is thought to promote the entry of the solvent into the yarn interior, perhaps by generating voids between adjacent constituent molecules, and thereby accelerate the dye extraction process. It is also theorized that thermal conditioning may tend to cause radial migration of dye molecules from the yarn interior toward the yarn surface which, contributes to the observed accelerated rate of dye extraction by the solvent in thermally treated yarns. Generally speaking, thermal conditioning of thermoplastic yarns is accompanied by thermal deformation or distortion of the yarns, e.g., softening, longitudinal shrinking, melting, or fusing of individual yarns. These effects are schematically depicted on various substrates in FIGS. 1 through 3. It is believed maximum rates of selective dye extraction in accordance with the teachings of this invention may be expected from those thermoplastic yarns or portions of yarns which exhibit such thermally induced deformations, as compared with thermoplastic yarns in which no thermal deformation is observed. However, such softening, shrinking, melting, or fusing, or other readily observable, external effects are not believed to be necessary to the practice of this invention. The degree to which such observable effects occur depends upon many factors, such as the type and composition of yarn used, the degree to which the individual yarns are free to shrink, the nature of the applied heat, etc.

It is also believed that conditioned polymeric yarns have increased voids between adjacent polymer molecules within the fibers comprising the yarns, as compared to unconditioned yarns of the same type, thereby enhancing the migration rate of solvent molecules into and out of the yarns.

The following table was prepared to quantify the effects of thermal conditioning on one example of a polyester yarn, using a preferred suitable solvent. A package of yarn, 20/2 T-811W Bright DACRON (DACRON is a trademark of DuPont), manufactured by Milliken & Company from DuPont polyethylene terephthalate fiber, was dyed in a laboratory package dye machine using Eastman Polyester Blue GLF (Color Index Name Disperse Blue 27). Lengths of this yarn were heat treated by immersion for 5 seconds in a fluidized bed, Model SBS-2 distributed by Fisher Scientific Company of Pittsburg, Pa., over a range from 300° F. to 500° F., in increments of 25° F. Measurements of length before and after heat treatment allowed calculation of the percent shrinkage at each temperature. Standard lengths were then solvent extracted by immersing them in 5 ml of methylene chloride at room temperature for one minute and then removing the yarn from the solvent. The UV-Visible spectra of these extracts were then recorded to yield the absorbence attributed to the blue dye at a wavelength of between 592 and 595 millimicrons, thereby giving an indication of the amount of dye extract by the solvent.

The results are tabulated below:

TABLE 1

| | 1 | 2 |
|---|---|---|
| PVC | 100* | 100* |
| Trioctyl trimellitate (TOTM) | 48 | 48 |
| Lead Stabilizer | 6 | 6 |
| Clay | 26 | 23.5 |
| Paraffin Lubricant | 0.2 | 0.2 |
| $MoO_3$ | — | 2.5 |
| | 180.2 | 180.2 |
| LOI | 26.5 | 27.5 |
| % Smoke | 8.5 | 5.8 |

*Parts by weight

It can be seen from this table that, for this particular yarn/solvent system, the rate of dye extraction generally increases after brief thermal conditioning at temperatures above about 300° F., and increases dramatically after brief thermal conditioning at temperatures extending from about 425° F. to somewhere between about 475° F. and 500° F., i.e., a temperature just below the melting point of the unconstrained yarn. Where the yarn is constrained, somewhat higher temperatures, i.e., 500° F. or above, may be employed to generate increased shrinkage and increased dye extraction rates.

After the fabric has been suitably heat treated in the desired pattern configuration, the fabric is then exposed for a controlled period of time to a solvent which, during that time period, selectively extracts dye from the heat treated areas only, and which has relatively little or substantially no effect upon those portions of the fabric surface which have not been heat treated in accordance with the teachings of thi invention. There is no requirement that the heat treated fabric be immediately exposed to the solvent, or be stored under any particular set of conditions following the pattern-wise heat treatment of the fabric. There is also no requirement that the fabric be dyed prior to the pattern-wise application of heat; good results may be obtained if a fabric is first subjected to the pattern-wise application of heat, then piece dyed, then exposed to a solvent, all in separate independent steps, in accordance with the teachings of this application. Because under such conditions the heat treated areas tend to pick up more dye than the untreated areas, extraction times may be extended, because more dye may be required to be extracted.

Any suitable solvent may be used. Solvents which have been used with fabrics containing polyester yarns which were dyed using disperse dyes include hot perchloroethylene and 1,1,1-trichloroethane. Other solvents which may be found to be satisfactory may be found in Table II of the technical article "Interactions of Nonaqueous Solvents with Textile Fibers-Part I: Effects of Solvents on the Mechanical Properties of a Polyester Yarn" by A. S. Ribnick, H.-D. Weigmann, and L. Rebenbeld, appearing in the *Textile Research Journal,* December 1972, at pages 720–726 (Table II at page 722) as well as in Table I of the technical article "Interactions of Nonaqueous Solvents with Textile Fibers-Part II: Application of the Solubility Parameter Concept to Polyester Fiber-Solvent Interactions" by B. H. Knox, H.-D. Weigmann, and M. G. Scott, appearing in the *Textile Research Journal,* March, 1975 at pages 203–217 (Table I at 206); the contents of these two tables are hereby expressly incorporated by reference.

A preferred solvent for polyester yarn/disperse dye combinations is methylene chloride, which may be used at room temperature and which is capable of extracting substantial quantities of disperse dye from pattern-wise heat treated polyester relatively quickly. In one embodiment, polyester-containing fabric which has been heat treated in a pattern-wise configuration may be immersed in a bath of methylene chloride at room temperature and agitated for a short period of time to assure proper circulation of the solvent in the vicinity of the yarns comprising the patterned areas of the fabric. The methylene chloride solvent can, in a matter of 30 to 60 seconds or less, extract substantially all the visible dye from those pattern areas of the fabric which have been heavily heat treated. During the same time period, the solvent will extract visibly less dye from pattern areas, or portions of individual yarns, which have been less heavily treated, i.e., exposed to lower temperatures, and will extract substantially no dye from those areas or yarns, or portions of yarns, which have not been heat treated. Using warm or hot methylene chloride solvent produces the same selective extraction effects, but within a substantially shortened time period—virtually complete dye extraction may be achieved in heavily patterned areas in a matter of a few seconds. It must be remembered that if solvent exposure time is not monitored carefully, complete dye extraction will occur in lightly treated or non-treated areas as well.

Means other than immersion may be used to bring the fabric into contact with the solvent if desired, e.g., the solvent may be sprayed on the fabric. It is also contemplated that, following application of the solvent, physical agitation of the yarns, to wash dye saturated solvent from the surface may be used to facilitate the extraction process. Means for halting solvent action may vary. Most simply, of course, the solvent may be washed or otherwise removed from the substrate surface after the desired "residence time" or exposure time has passed.

It is preferred that the chosen solvent be one which is not readily flammable, and of course should be one which is neither grossly toxic to humans nor destructive to the yarns used. It is believed that suitable solvents should be selected from those solvents having a hildebrand solubility parameter ($\delta$) which is appropriate to the yarn of interest. It has been found, for example, that for yarns consisting essentially of polyethylene teraphthalate ($\delta \approx 10.7$) workable solvents should have hildebrand solubility parameter values within the range of about 8 to about 14. Solvents having values closest to 10.7 do not necessarily result in maximum dye extraction rates and are not necessarily preferred over other solvents having more extreme values. Factors such as the size and therefore the accessibility of the solvent molecule relative to the voids between the polymer chains within the fibers which make up the yarn must be accommodated. High solvent migration rates are desirable. Solvents having values substantially higher or lower than 10.7 may interact quite well with different portions of the polyethylene teraphthalate molecule and produce high dye extraction rates. It has been found that suitable solvents having solubility parameter values between about 9 and about 10, and also between about 11.5 to about 13, often work quite well; suitable solvents from the former group tend to interact well with the aromatic portion of the polyethylene teraphthalate molecule, while solvents from the latter group tend to interact well with the aliphatic portion of that molecule.

The following Examples are intended to describe particular applications of the invention, and are not intended to be limiting. The device used to pattern the fabric with streams of heated or hot air was similar to those devices disclosed in commonly assigned U.S. patent application Ser. No. 253,135 and U.S. Pat. No. 4,364,156, referenced and made a part of this disclosure hereinabove.

EXAMPLE 1

A 100% polyester napped pile fabric having a weight of 10 oz. per square yard, identified by Milliken & Company as Style 8301, was conventionally dyed with disperse dyes to give a uniform medium brown color. The fabric was then treated with streams of hot air from the heated air device described hereinabove to generate a sculptured pile fabric having a pin dot array of depressed, thermally shrunken yarns. The fabric speed in the device was 6.5 ypm; the manifold air temperature was about 670° F. The coloration in the sculptured prior to exposure to the solvent areas was slightly darker than in the background area, where the pile remained substantially erect. The patterned fabric was immersed in a bath of methylene chloride at 23° C. for one minute, removed, and dried in a stream of room temperature air. When completely dry the fabric exhibited a pattern of very light brown sculptured dots on a background substantially unchanged in color. The contrast exhibited by the pattern areas on the treated sample was excellent, and the pattern was very easy to see from any angle.

EXAMPLE 2

A 44 gauge double needle bar raschel knit polyester pile fabric, identified by Milliken & Company as Style 6590 having a weight of approximately 9 oz./yd.$^2$ was dyed with a disperse dye to give a uniform deep blue color. This fabric was treated with streams of hot air using the device disclosed above to yield a dot array of thermally shrunken pile. The fabric speed in the device was 25 ypm; the manifold air temperature was about 820° F. When treated with methylene chloride as described above for 1 minute, removed and air dried, the final product exhibited a uniformly deep blue field with a substantially white pin dot array, corresponding exactly to the shrunken pile areas, superimposed thereon.

EXAMPLE 3

A raschel knit pile fabric of 100% polyester, identified by Milliken & Company as Style 180 having a weight of approximately 5 oz./yd.$^2$ was dyed to a uniform green color with disperse dye. The fabric was treated with streams of hot air in pattern configuration using the above-referenced device. The fabric speed in the device was 7 ypm; the manifold air temperature was about 700° F. A sculptured image was obtained which was difficult to read at all angles of light. The fabric was then dipped in methylene chloride at 23° C. for 30 seconds, removed and dried with a stream of cool air to yield a highly contrasting design of white against a green background that was much more readable than the untreated patterned fabric.

EXAMPLE 4

A 100% polyester knit fabric (interlock) manufactured by Milliken & Company and identified as Style 2651 having a weight of 3.0 oz.yd.$^2$ was dyed to a deep blue shade using disperse dye and imaged by computer controlled streams of heated air using the above-referenced device. The fabric speed in the device was 3.75 ypm; the manifold air temperature was about 820° F. Prior to exposure to the solvent, the image was darker in the heated area. When dipped in methylene chloride at 23° C. for 30 seconds and air dried, the imaged area became lighter. A second portion of the same fabric, similarly patterned and exposed to methylene chloride for 60 seconds, exhibited contrast which was even greater, with the color of the unimaged area remaining constant.

EXAMPLE 5

A woven fabric containing an intimate blend of polyester and cotton in the ratio 65/35 manufactured by Milliken & Company and identified as Style 2602, weighing approximately 4.75 oz./yd. was union dyed to a navy blue shade. The fabric was imaged with hot air streams to yield a diamond pattern with flowers in the center, using the above-referenced device. The fabric speed in the device was 6 ypm; the manifold air temperature was about 700° F. On the dark navy fabric, there was only slight contrast between the imaged and the unimaged areas. After dipping in methylene chloride at 23° C. for 1 minute, the dye was extracted from the polyester yarns that had been thermally deformed by the hot air while the dye in the cotton fibers remained unaffected. The result was a light blue pattern on a darker navy background due to extraction of the dye within the polyester fibers.

EXAMPLE 6

A napped woven fabric containing a disperse-dyeable polyester yarn in the filling direction and a cationic-dyeable polyester yarn in the warp direction was woven in such a way that, after cross-dyeing, napping created a sculptured effect consisting of square-shaped non-pile areas, approximately 0.1 inches per side, which appeared black (cationic dye) in a field of grey (disperse dyed nap). The fabric was manufactured by Milliken & Company and identified as Style 8317 having a weight of approximately 10 oz./yd.$^2$. The fabric was imaged with a stream of hot air using the above-referenced device. The fabric speed in the device was 6.75 ypm; the manifold air temperature was about 670° F. The fabric was immersed in methylene chloride at 23° C. for 1 minute, then dried. The resulting pattern showed a highly contrasting white pattern area, and a black pin dot on a grey background. The resulting effect was multicolor and showed good contrast with the cationic dye removed to a much lesser extent, if at all, by the solvent extraction process.

EXAMPLE 7

A woven polyester fabric having both cationic-dyeable polyester yarn and disperse-dyeable polyester yarn, identified as Style 8327 having a weight of 9.5 oz./yd.$^2$ was cross-dyed and then patterned with a stream of heated air at 760° F. in the above-referenced device. Fabric speed was 6.75 ypm. The patterned fabric was then dipped in methylene chloride for 1 minute at 23° C. After 1 minute the sample was removed and dried. It showed strong contrast where the hot air had impinged, giving very light diagonal blue line pattern against a field of medium-to-dark blue yarns.

EXAMPLE 8

The fabric of Example 1 was similarly treated with hot air. The treated fabric was then immersed for 5 seconds in a bath of methylene chloride heated to 35° C. The results after removal from the solvent and drying were substantially identical to those achieved in Example 1.

EXAMPLE 9

The procedures of Example 1 were followed, except that acetone heated to 53° C. was substituted for methylene chloride. The results were similar to those achieved in Example 1.

EXAMPLE 10

The procedures of Example 1 were followed, except that 1,1,1-trichloroethane at 70° C. was substituted for the methylene chloride. The results were similar to those achieved in Example 1.

EXAMPLE 11

The procedures of Example 1 were followed, except that perchloroethylene at 95° C. was substituted for the methylene chloride, and the exposure time was extended to 5 minutes. The results were similar to those achieved in Example 1.

EXAMPLE 12

The procedures of Example 1 were followed, except that ethanol at 73° C. was substituted for the methylene chloride, and the exposure time was extended to 5 minutes. A very slight change in the visual dye concentration was observed in the treated areas.

EXAMPLE 13

The procedures of Example 1 were followed, except that the heat treatment with hot air streams was done prior to conventional dyeing. The resulting fabric contained dark brown dots on a medium brown field. Exposure of the patterned fabric to methylene chloride for one minute at 23° C. resulted in a noticeable visual lightening of the dot areas. Further exposure, for a total exposure time of 5 minutes, resulted in a fabric exhibiting light beige dots on a medium brown field.

I claim:

1. A method for patterning the surface of a textile substrate comprising polyester yarns containing a disperse dye by treating said surface in pattern-wise configuration comprising the steps of:

(a) selectively applying a heat treatment to pattern areas on said surface of said substrate to enhance the extractability of said dye from at least some polyester yarns within said pattern areas by solvent extraction, while maintaining said surface in pattern-complementary areas in an untreated condition;

(b) exposing said surface to a solvent which selectively extracts a visually significant quantity of said dye contained in said some polyester yarns in said treated pattern areas before said solvent extracts a visually significant quantity of dye from said untreated pattern-complementary areas, said solvent being selected from the group consisting of methylene chloride, acetone, 1,1,1-trichloroethane, perchloroethylene, and ethanol; and (c) halting said solvent extraction after the desired degree of dye extraction in said pattern and pattern-complementary areas has occurred.

2. The method of claim 1 wherein said treatment comprises decreasing the relative internal orientation of treated yarns within said pattern areas.

3. The method of claim 1 wherein said solvent is a member of the group consisting of methylene chloride, perchloroethane, and 1,1,1-trichloroethane.

4. A method for patterning the surface of a textile substrate comprising yarns of polyethylene teraphthalate which have been dyed with a disperse dye, comprising the steps of:

(a) applying heat to dyed yarns in areas of said substrate forming a pattern configuration, said heat being sufficient to increase significantly the speed at which a selected solvent extracts disperse dye from said yarns in said selected areas following said application of heat compared with yarns which have not been so heated;

(b) applying a solvent which selectively extracts disperse dye from said dyed yarns to which heat has been applied in accordance with step (a) at a speed substantially higher than the speed at which said solvent extracts dye from other of said dyed yarns on said substrate surface, said solvent being selected from the group consisting of methylene chloride, acetone, 1,1,1-trichloroethane, perchloroethylene, and ethanol; and (c) halting said solvent extraction after the desired degree of dye extraction has occurred.

5. The method of claim 4 wherein said heat is sufficient to induce thermal deformation of yarns in said selected areas.

6. The method of claim 4 wherein said heat is applied by directed streams of heated fluid onto said substrate surface in pattern-wise configuration.

7. The method of claim 4 wherein said heat is applied by directing a laser onto said substrate surface in pattern wise configuration.

8. The method of claim 4 wherein said yarns are dyed prior to said treatment.

9. The method of claim 4 wherein said yarns are dyed following said treatment.

10. The method of claim 6 wherein said solvent is a member of the group consisting of methylene chloride, perchloroethane, and 1,1,1-trichloroethane.

11. A method for applying a pattern having high visual contrast to a fabric surface comprised of polyester yarns dyed with a disperse dye, said method comprising the steps:

(a) heating dyed yarns in selected areas of said substrate forming a pattern configuration to a temperature within the range of about 325° F. to about 500° F.;

(b) exposing said substrate to a solvent, said solvent having a solubility parameter within the range of about 8 to about 14 hildebrands and being capable of selectively extracting disperse dye from said yarns which have been heated in accordance with step (a) at a rate significantly faster than from yarns which have not been so heated; and (c) halting said solvent extraction after sufficient dye extraction has occurred to yield the desired degree of visual contrast.

12. The method of claim 11 wherein said solvent is a member of the group consisting of methylene chloride, perchloroethane, and 1,1,1-trichloroethane.

13. The method of claim 11 wherein said heat is applied by directed streams of heated fluid onto said substrate surface in pattern-wise configuration.

14. The method of claim 11 wherein said heat is applied by directing a laser onto said substrate surface in pattern-wise configuration.

* * * * *

UNITED STATES PATENT AND TRADEMARK OFFICE

CERTIFICATE OF CORRECTION

PATENT NO. : 4,680,034

DATED : July 14, 1987

INVENTOR(S) : Robert C. Arnott

It is certified that error appears in the above-identified patent and that said Letters Patent is hereby corrected as shown below:

Column 4, lines 13-25, delete "Table 1" and insert the following:

Table 1

% Shrinkage, Absorbance Of Heat Treated Polyester Yarn

| Temperature | % Shrinkage | Relative Absorbance |
|---|---|---|
| 300 | 0 | .048 |
| 325 | 0.2 | .092 |
| 350 | 0.8 | .108 |
| 375 | 3.5 | .057 |
| 400 | 6.8 | .043 |
| 425 | 9.6 | .070 |
| 450 | 20.5 | .349 |
| 475 | 28.2 | .699 |
| 500 | Melted | - - - |

Column 4, line 44, the word "thi" should be --this--.

UNITED STATES PATENT AND TRADEMARK OFFICE

CERTIFICATE OF CORRECTION

PATENT NO. : 4,680,034

DATED : July 14, 1987

INVENTOR(S) : Robert C. Arnott

It is certified that error appears in the above-identified patent and that said Letters Patent is hereby corrected as shown below:

Column 4, line 44, the word "thi" should be --this--.

Signed and Sealed this

First Day of December, 1987

*Attest:*

DONALD J. QUIGG

*Attesting Officer*

*Commissioner of Patents and Trademarks*